United States Patent [19]

Mettier

[11] 4,244,331

[45] Jan. 13, 1981

[54] FREE PISTON GAS GENERATOR ASSEMBLIES

[76] Inventor: Robert N. Mettier, 8951 Farralone Ave., Canoga Park, Calif. 91304

[21] Appl. No.: 940,887

[22] Filed: Oct. 6, 1978

[51] Int. Cl.[3] ..... F02B 71/02; F02D 39/10

[52] U.S. Cl. ..... 123/46 A; 123/46 B; 123/192 B

[58] Field of Search ..... 123/46 R, 46 A, 46 B, 123/192; 137/107

[56] References Cited

U.S. PATENT DOCUMENTS

| | | | |
|---|---|---|---|
| 2,434,778 | 1/1948 | Welsh | 123/46 R |
| 2,438,134 | 3/1948 | Spier | 60/14 |
| 2,462,745 | 2/1949 | Horgen | 123/46 R |
| 2,578,162 | 12/1951 | Wallace | 123/46 R |
| 2,849,995 | 9/1958 | Lewis | 123/46 R |
| 3,027,907 | 4/1962 | Lee | 137/107 |
| 3,073,108 | 1/1963 | Ward | 123/46 B |
| 3,159,331 | 12/1964 | Boldt et al. | 123/46 R |
| 3,853,100 | 12/1974 | Braun | 123/46 R |

OTHER PUBLICATIONS

Wise, Free-Piston Engine: Power Plant with a Future, Jan. 23, 1958, Machine Design pp. 22–24.

*Primary Examiner*—Craig R. Feinberg

*Attorney, Agent, or Firm*—Nilsson, Robbins, Dalgarn, Berliner, Carson & Wurst

[57] ABSTRACT

A free piston gas generator assembly in which the scavenging efficiency of the power cylinder is increased, by interconnecting in series a plurality of three or more identical motor-compressor cylinders, by means of a piping system, into one engine assembly. Said interconnecting piping system constitutes a closed feedback or bounce energy transfer loop, by transferring the feedback or bounce energy of the up-stream motor-compressor cylinder to the down-steam motor-compressor cylinder in a continuous stepwise sequence. Consequently, the simultaneous outward and inward synchronized piston strokes of two motor-compressor cylinders in each working step, causes the pistons of the remaining motor-compressor cylinders in the assembly to be at rest in the outward dead points, where scavenging takes place. Hence, the number of motor-compressor cylinders interconnected by the feedback or bounce energy transfer loop and the cyclic frequency of the synchronized piston strokes, determines the scavenging time available for each of them, independently of the inertia of the respective piston mass.

9 Claims, 5 Drawing Figures

FREE PISTON GAS GENERATOR ASSEMBLIES

BACKGROUND OF THE INVENTION

This invention relates to an internal combustion engine of the free piston gas generator type, in which the entire energy output of the engine assemblies resides in the products of combustion, mixed with excess scavenging air, flowing through the motor cylinders at an elevated temperature and pressure, into a common exhaust header. The hot gases so generated may be used as example in either reciprocating or rotary prime movers.

It is known that the output efficiency of the existing free piston engine is closely related to the scavenging efficiency of the power cylinder and since the scavenging takes place at the outer dead points of the piston strokes, it is obvious that the rapidity of the stroke reversals at these points directly affects scavenging efficiency.

Concequently small free piston engines with low piston inertia, possess very rapid stroke reversals with poor output efficiency, while large free piston engines with large piston inertia possess less rapid stroke reversals with a relatively good output efficiency.

For example, existing single cylinder engines of this type in the 1000 gas H.P. output range are run with an efficiency of over 40% at 600 cycles per minute, while small engines in the 50 gas H.P. output range are run with an output efficiency of 12% at best, because of excessive fouling of the combustion air with trapped exhaust gas and lost energy for high super charging.

The purpose of this invention is to overcome the scavenging handicap of the presently known free piston gas generator engine without altering its inherently good features, regardless of output range.

In order that the present invention may be fully understood, reference is made to the accompanying drawings and diagram, forming part of this specification and illustrating by way of examples some embodiments of free piston gas generators according to the present invention and wherein:

Figure 3:
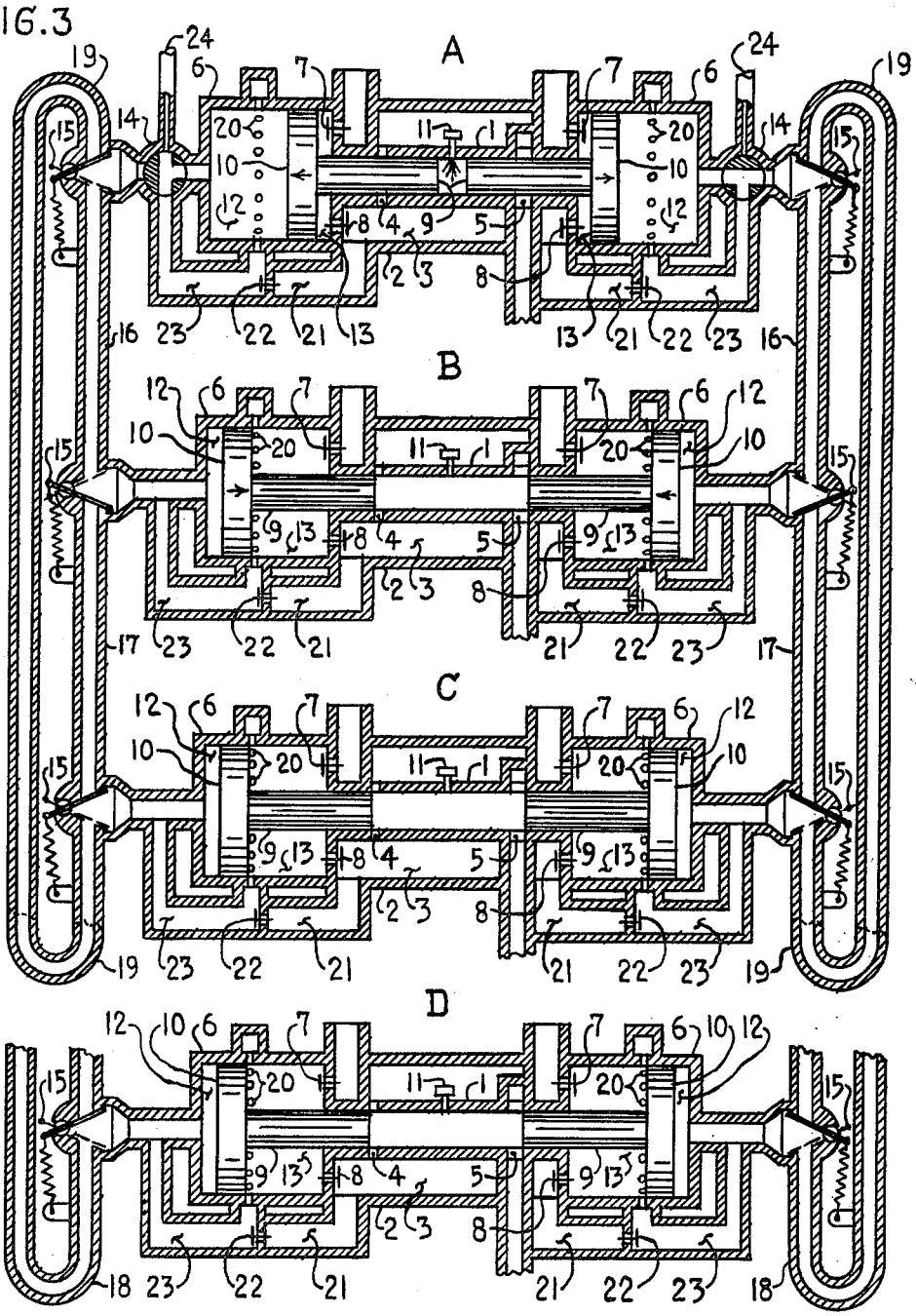
FIG. 3 is a diagrammatic axial sectional view of a free piston gas generator of the inward compression type with starting valves and pneumatic transfer of the feedback or bounce energy, showing one embodiment of the present invention.

The engine assembly shown in FIG. 3, includes three identical motor-compressor cylinders, each of them being by itself a free piston gas generator engine, called for convenience thereafter engine cylinder "A", "B" and "C", with one additional optional engine cylinder "D" at the bottom. Said engine cylinders are interconnected by a piping system, forming a feedback or bounce energy transfer loop and supported by a suitable common frame (not shown), spacing them equidistant and parallel in relation to each other.

Each engine cylinder is made up of the motor cylinder 1, a casing 2, surrounding said motor cylinder and made to include a chamber 3 constituting a scavenging air receiver. Inlet scavenging ports 4 in the side of the motor cylinder adjacent an end thereof, permit scavenging air to flow into the motor cylinder 1 from the scavenging chamber 3 and through exhaust ports 5 in the opposite end, conducting the products of combustion mixed with it, out of the motor cylinder 1 into a common exhaust header (not shown).

Except for the porting of the motor cylinder 1 the entire assembly is symmetrical about a central transverse plane so that the following description of one half of the engine assembly will suffice for the opposite half.

At the ends of the motor cylinder 1, an enlarged compressor cylinder 6 is provided, having valved inlet ports 7 and discharge ports 8 communicating with the scavenging air receiver 3.

Inside the motor cylinder 1, two motor piston assemblies 9 with an enlarged compressor piston 10 rigidly connected to the outer ends thereof, reciprocate in opposite direction, synchronized through suitable known means (not shown) and coact respectively when they get to the outer dead points of their strokes, with inlet and exhaust ports 4 and 5. The outer faces of the compressor pistons 10 and the outer ends of the compressor cylinders 6 include in combination, transfer chambers 12.

When the two piston assemblies 9 of engine cylinder "A" are forced into their inward strokes by a compressed air surge, delivered into the transfer chambers 12 through the starting valves 14 in the starting position, or through the pipe sections 19 and transfer valves 15, with said starting valves 14 in the running position (as shown at the right hand side of FIG. 3), the air trapped in the motor cylinder 1 is compressed to a temperature sufficient to ignite the fuel which is injected into the center of motor cylinder 1, through fuel injector 11. The fuel injection devices are as usual and not shown.

The combustion energy from the injected fuel inside motor cylinder 1 drives the two piston assemblies 9 outward again and a new air charge is taken into the compressor chambers 13 by the suction of compressor piston 10 sliding inside cylinder 6 and through valved inlet ports 7. At the same time, air under pressure trapped in transfer chambers 12, between compressor piston 10 and the outer end-wall of compressor cylinder 6, is driven through the starting valves 14 in the running position (as shown at the right hand side of FIG. 3) and the open transfer valves 15 into pipe sections 16.

The resulting pressure surge flowing through pipe sections 16 opens the transfer valves 15 of engine cylinder "B" by overcoming the spring force acting on said valves and closing off at the same time pipe sections 17, thereof forcing through the pressure increase inside transfer chambers 12, the motor piston assemblies 9 of engine cylinder "B" into the inward stroke.

Hence by the time the motor piston assemblies 9 of engine cylinder "A" have reached their outward dead points, the motor piston assemblies 9 with the attached compressor pistons 10 of engine cylinder "B" have been forced into their inward dead points, pushing thus simultaneously the air trapped in the compressor chambers 13 through the discharge ports 8 into the scavenging air receiver 3, while the motor piston assemblies 9 inside engine cylinder "A" uncover first the exhaust ports 5 and then the scavenging ports 4 respectively, whereby the scavenging process of motor cylinder 1 inside engine cylinder "A" is started.

At the same time the compressor pistons 10 uncover the compressor cylinder ports 20 of engine cylinder "A", relieving consequently the pressure surge in pipe sections 16 and transfer chambers 12 through ducts 23, which feed into the compressor chambers 13. This causes the pressure of the new air charge previously taken in, to increase from or below atmospheric and to equalize by means of ducts 21 and bypass valves 22 to the pressure existing at that time in the scavenging air receiver 3 of said engine cylinder "A". Further as soon as the pressure surges in pipe sections 16 are relieved, the transfer valves 15 of engine cylinder "B" will close the ports of said pipe sections 16 by way of the spring force acting on them and open the down-stream port of pipe sections 17, ducting thus the forthcoming pressure surge from engine cylinder "B" to the transfer chambers 12 of engine cylinder "C".

As a result, before the scavenging phase of the motor cylinder 1 inside engine cylinder "A" is completed, the pressures in pipe sections 16, transfer chambers 12, scavenging air receiver 3 and compressor chamber 13 are all equalized, causing the motor piston assemblies 9 of engine cylinder "A" to remain in the outward dead point position for a certain time period, during which the scavenging of motor cylinder 1, through the open ports 4 and 5 is continued, until terminated by a new pressure surge arriving from pipe sections 19 and transfer valves 15, pushing the motor piston assemblies 9 of said engine cylinder "A" inward again.

Figure 2:
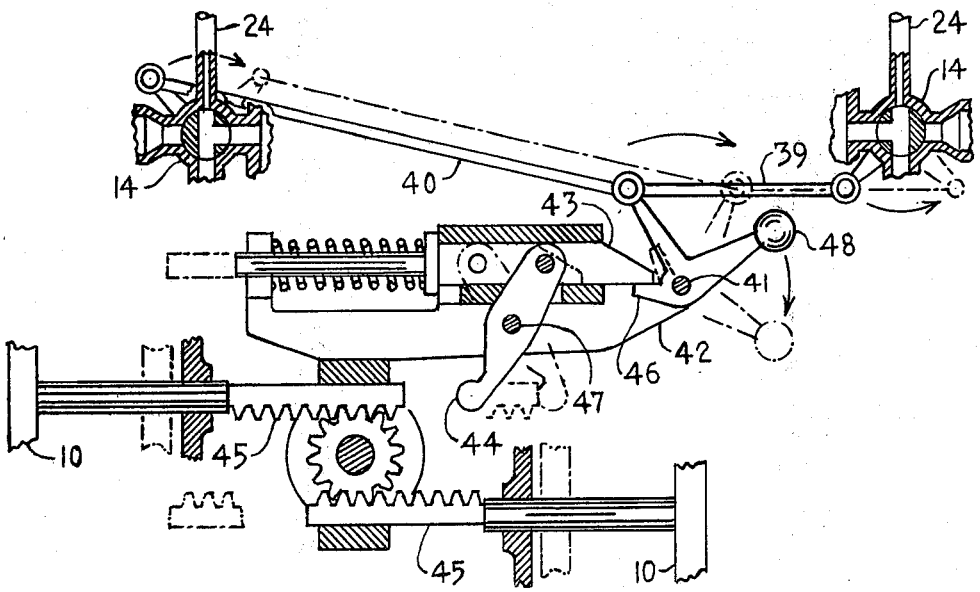
FIG. 2 is a diagrammatic view showing one embodiment of starting valves with actuator and interlocking device of the present invention.

To start the above described engine assembly, the starting valves 14 of engine cylinder "A" are rotated simultaneously into the starting position as shown on the left side of FIG. 3, by suitable means as shown in FIG. 2, closing off the duct to transfer valves 15 and connecting the transfer chambers 12 with a pressurized air source (as usual and not shown) through piping 24. This forces the motor piston assemblies 9 into the inward stroke, compressing the air trapped inside motor cylinder 1 and to ignite the injected fuel.

The combustion energy drives the motor piston assemblies 9 into the outward dead points, where scavenging takes place and at the same time compressing the trapped air inside the transfer chambers 12 and the connected air source through piping 24. Hence as long as the starting valves are in the starting position, the transfer chambers 12 of engine cylinder "A" act as bounce chambers, returning the motor piston assemblies 9 of said engine cylinder "A" by way of the bounce pressure surge, immediately into the inward stroke. Thereby the engine cylinder "A" continues to work as a single cylinder engine without transfer of the feedback or bounce energy to engine cylinder "B".

After a short idling and warm-up period, the starting valves 14 are rotated into the running position as shown at the right hand side of FIG. 3. However a suitable interlocking device as shown as example in FIG. 2, prevents the rotation of the starting valves from starting to running position, unless the motor compressor piston assemblies 9 of engine cylinder "A" are close to the inward dead points, allowing thus the following pressure surge from the outward strokes of said piston assemblies 9 to be transferred from the transfer chambers 12 of engine cylinder "A" through pipe sections 16 to the transfer chambers 12 of engine cylinder "B", while the check valves 22 prevent said pressure surges to leak into the scavenging air receiver 3 of engine cylinder "A".

Therefore the above described events in engine cylinder "A" are repeated in engine cylinder "B", whereas the motor piston assemblies 9 of engine cylinder "A" remain in the scavenging position.

The following pressure surge exiting from engine cylinder "B" is thereafter transferred through pipe section 17 to the engine cylinder "C", while in turn the motor piston assemblies 9 of engine cylinder "B" remain also in the scavenging position. The pressure surge emerging from engine cylinder "C" is then transferred through pipe sections 19, back to transfer chambers 12 of engine cylinder "A", thereby terminating the scavenging period of said engine cylinder "A" and completing the transfer loop from engine "A" to "B", from "B" to "C" and from "C" back to "A" and so on. Hence as long as the fuel supply to said cylinders is not cut off, the respective motor piston assemblies 9 will continously reciprocate in a stepwise sequence as described, whereby every step is caused by the scavenging period of each respective motor piston assembly 9 at rest in the outward dead points or scavenging position inside their engine cylinders.

As a result, the time period or scavenging time, during which each motor piston assembly 9 is inactive and at rest in sequence, in the outward dead point or scavenging position, is a function of cyclic speed and the number of identical engine cylinders interconnected in series by their pipe sections, forming part of the feedback or bounce energy transfer loop and thus independent of the motor piston assembly inertia, freeing the designer to consider large piston masses as a means to obtain a reasonable scavenging time.

The starting valves 14 of engine cylinder "A" shown in the starting position as depicted in FIG. 2, include a starting control lever 48 with interlocking linkages 39 and 40. Said control lever 48 rotates on a pivot 41 of support frame 42 and engages with a protrusion 46 the spring loaded sliding catch 43, preventing thereof the rotation of said control lever 48 and with it the interconnected starting valves 14 from the starting to the running position, unless sliding catch 43 is retracted against the spring force by lever 44. Lever 44 rotates on a pivot 47 of support frame 42 and in turn is pushed into the retracting position, each time the motor piston synchronizing rack 45, which is rigidly connected to the compressor piston 10, reaches the inward dead points of the piston stroke. Whereas the rotation of the starting valves 14 from the running to the starting position is always possible, regardless of the position of the compressor piston 10, because said protrusion 46 of control lever 48 slides on the provided slope of catch 43 and pushes it back against the spring force.

Figure 4:
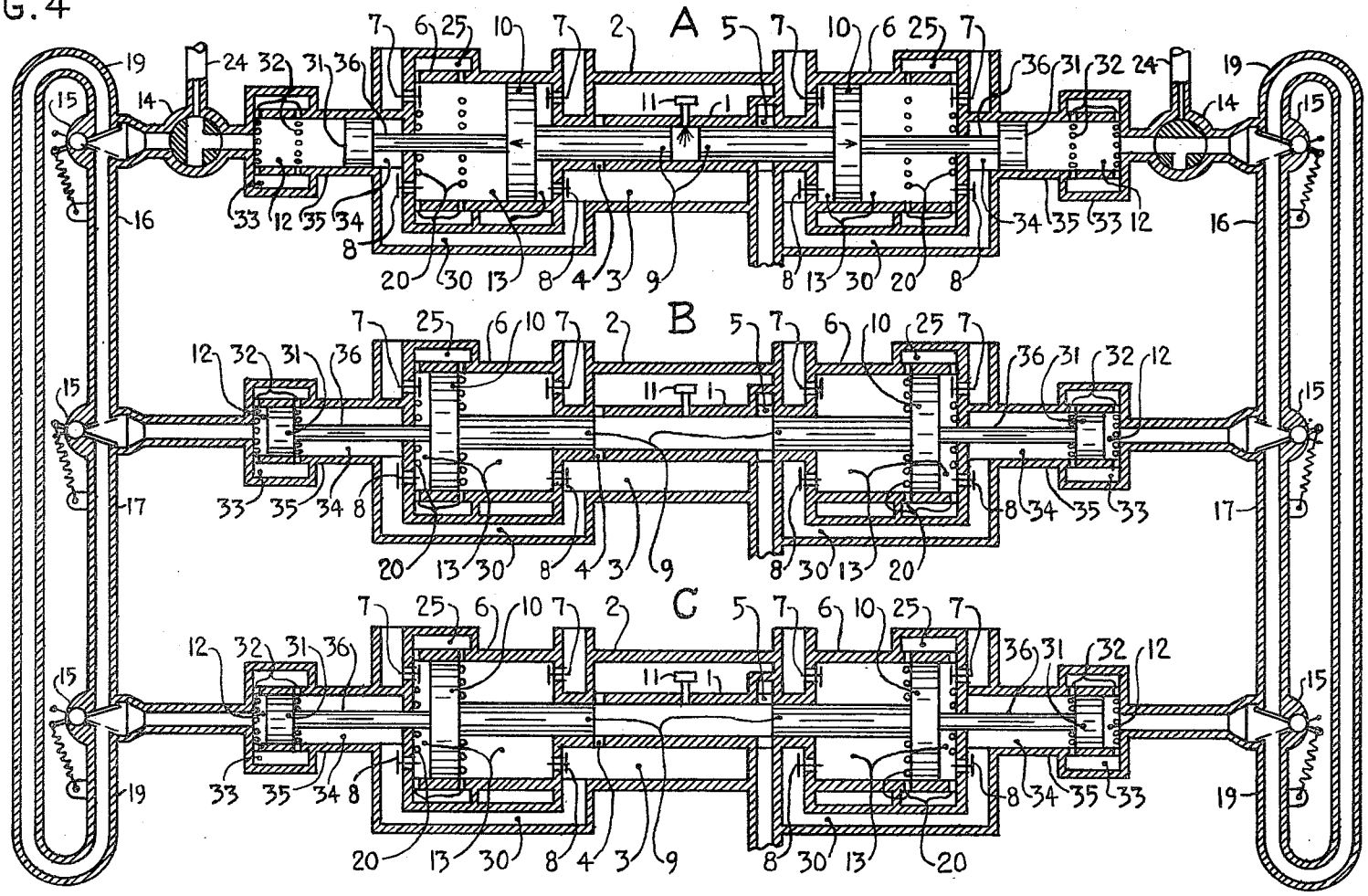
FIG. 4 is a diagrammatic view of a free piston gas generator of the double acting compressor type, with starting valves and pneumatic transfer of the feedback or bounce energy, depicting another embodiment of the present invention.

The engine assembly shown in FIG. 4, is identical in principle and functional aspects as the one described and shown in FIG. 3, including the starting means, except that the compressor pistons 10 are double acting, since both piston faces compress the previously, through the intake valves 7 drawn new air charges and discharge them through valves 8 and ducts 30 into the scavenging air receiver 3, doubling thus the output of the compressor cylinders 6.

Another exception is that the compressor piston 10 of the motor piston assemblies 9 are fitted with an additional piston 31, rigidly connected to them by the means of piston rods 36 and surrounded by cylinder casings 35, to thereby provide for the transfer of the feedback or bounce energy. The cylinder casings 35 are an outward extension of cylinder casings 6. The outward faces of the transfer pistons 31 are made to include the transfer chambers 12 with the same functions as described in FIG. 3, while the inward faces of said transfer pistons 31 together with cylinder casings 35 include pressure equalizing chambers 34.

Consequently when the transfer pistons 31 of engine cylinder "A" reach the outward dead points, the air pressure in the downstream pipe sections 16 and transfer chambers 12 are again relieved and equalized with the air pressure existing inside the scavenging air receiver 3, through cylinder casing ports 32 and ducts 30 and 33. Hence the down-stream transfer valves 15 switch back to the normal spring loaded position by closing said pipe sections 16 of and opening the ports of pipe sections 17.

At the same time the compressor pistons 10 uncover the cylinder ports 20, interconneted through ducts 25, whereby the pressures on both piston faces 10 are also equalized. Therefore all the forces acting on the pistons 9, 10 and 31 are cancelled out, whilst in the outward dead points or scavenging position, with the result that said motor piston assemblies 9 remain as described in FIG. 3, in said outward dead point position during the exhaust and scavenging period of motor cylinder 1 of the respective engine cylinder "A", "B" and "C".

Figure 5:
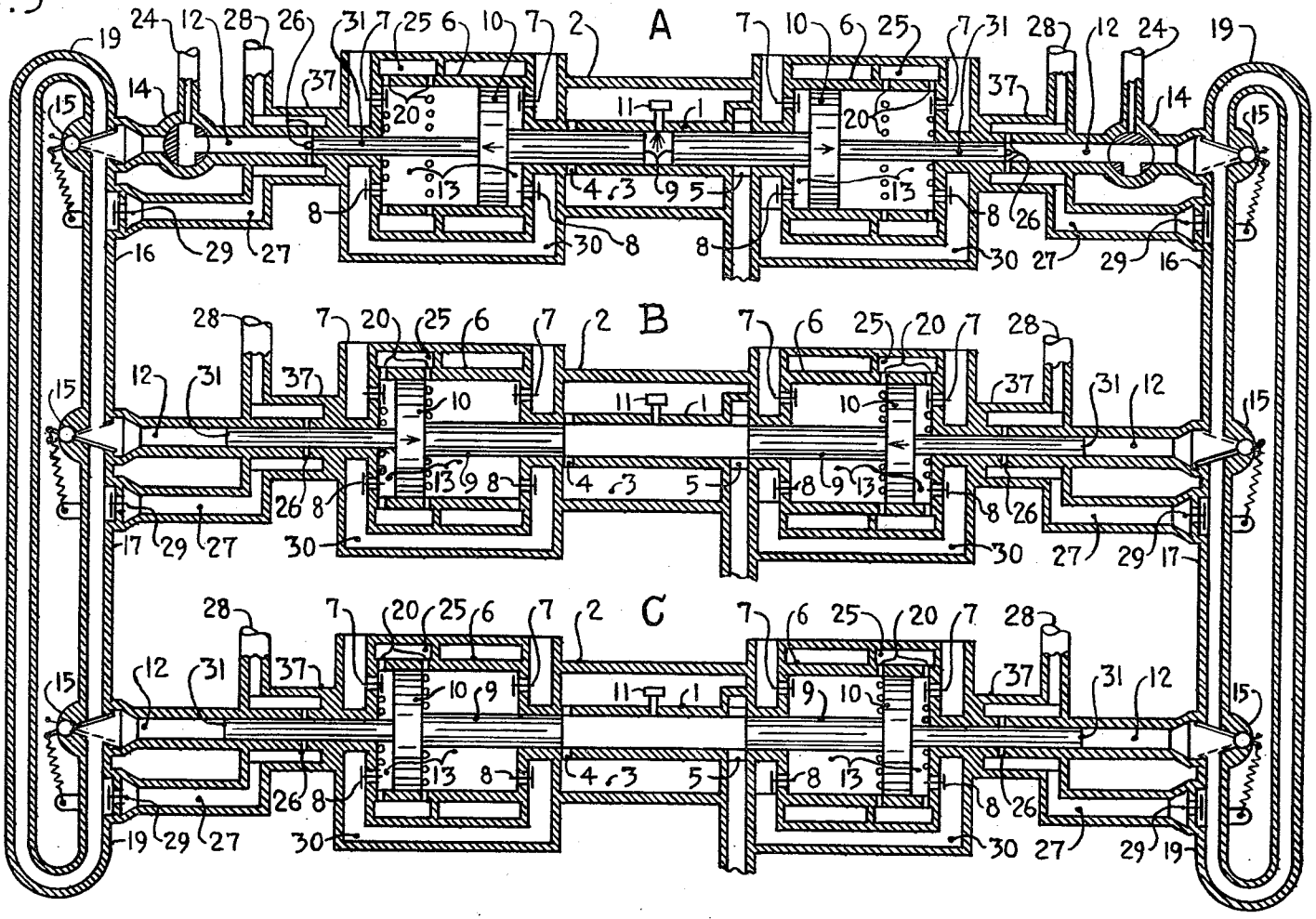
FIG. 5 is a diagrammatic axial sectional view of a free piston gas generator of the double acting compressor type with starting valves and hydraulic transfer of the feedback or bounce energy, showing a further embodiment of the present invention.

The engine assembly illustrated in FIG. 5 is also identical in principle and functional aspects as the one described and shown in FIG. 3, except that the transfer medium of the feedback or bounce energy is an hydraulic fluid in contrast to the pneumatic transfer medium described in FIG. 3 and FIG. 4.

Another exception from FIG. 3, is that the compressor pistons 10 are also double acting as shown and described in FIG. 4.

A further exception is that the motor piston assemblies 9 are fitted with hydraulic pistons 31, rigidly connected to the outward faces of the compressor pistons 10. Said pistons 31 reciprocate inside cylinder casings 37 which are an outward extension of cylinder casings 6.

To start the engine assembly shown in FIG. 5, the starting valves 13 in engine cylinder "A" are rotated simultaneously into the starting position, closing off the duct to transfer valves 15 and connecting the transfer chambers 12, through piping 24, with an hydraulic accumulator equipped with an internal gas cushion under pressure, of known design (not shown).

Said gas cushion drives the hydraulic fluid into the transfer chambers 12 of engine cylinder "A", forcing thus the motor piston assemblies 9 into the inward dead points and compressing the trapped air inside motor cylinder 1, wherein the resulting temperature raise ignites the injected fuel.

The combustion energy thus generated, drives the motor piston assemblies 9 into the outward dead points or scavenging position and at the same time forces the hydraulic fluid back, through piping 24 into the accumulator, wherein said gas cushion under pressure acts as a bouncing spring, driving the hydraulic fluid again into the transfer chambers 12 and with it the motor piston assemblies 9 into the inward dead points, compressing the trapped air and igniting the injected fuel and so on.

Hence as long as the starting valves 14 are in the starting position as shown at the left hand side of FIG. 5 and the transfer chambers 12 of engine cylinder "A" in combination with piping 24 and the cushion spring of the accumulator, act as a bounce chamber, the motor piston assemblies 9 of said engine cylinder "A" are returned immediately into the inward dead points. Thereby the engine cylinder "A" continues to work as a single cylinder engine without the transfer of the feedback or bounce energy to engine cylinder "B" and without the advantage of an increased scavenging time period as described and shown in FIG. 3 and FIG. 4.

Turning the starting valves 14 as described in FIG. 2, simultaneously from the starting to the running position, by closing piping 24 and opening the duct to transfer valves 15, as described for the engine shown in FIG. 3, causes the following hydraulic pressure surge from the outward piston strokes, to be transferred from transfer chambers 12 of engine cylinder "A", through the valves 15 and pipe sections 16, to the transfer chambers 12 of engine cylinder "B", forcing the motor piston assemblies 9 of said engine cylinder "B" into the inward dead points.

Therefore the hydraulic transfer medium will accomplish the same stepwise reciprocating piston motion in a continuous sequence from engine cylinder "A" to "B", from "B" to "C" and from "C" back to engine cylinder "A" and so on, as described with the pneumatic transfer medium working in the engine assemblies shown in FIG. 3 and FIG. 4.

An other exception to the description of FIG. 3 and FIG. 4, is that each time the hydraulic transfer pistons 31 of FIG. 5 reach their inward dead points, the ports 26 of cylinder extensions 37 are uncovered, relieving and equalizing thus the pressure of the hydraulic fluid in ducts 27, the transfer chambers 12 and the related up—and down—stream pipe sections of the transfer loop, through transfer valves 15.

This action causes the motor piston assemblies 9 of the up-stream engine cylinder to remain in the outward dead points or scavenging position, since the pressure acting on the faces of the related comressor pistons 10 are also equalized through the compressor cylinder ports 20 and the external interconnecting ducts 25.

Furthermore the transfer valves 15 being relieved of any pressure differential, switch at the same time position, actuated by spring force, closing thus the upstream pipe sections and opening simultaneously the respective down-stream pipe sections of said transfer loop. Consequently the following hydraulic feedback pressure surge, caused by the outward strokes of said hydraulic pistons 31, is ducted into the down-stream pipe sections and by opening the related transfer valves 15, into the transfer chambers 12 of the down-stream engine cylinder and so on, in sequence as described above in FIG. 3 and FIG. 4.

The check valves 29 are required to prevent the hydraulic fluid from escaping through ducts 27 and pipes 28 into the hydraulic reservoir from the respective pipe sections of the transfer loop, each time the feedback or bounce energy surge is transferred by said fluid from the up-stream engine cylinder to the down-stream engine cylinder.

The cooling and lubricating means for the described engine assemblies are conventional and not shown. The transfer valves 15 in FIG. 3, 4 and 5, shown in a diagrammatic sectional view are of the flapper type, because their simplicity make it easy to described their operating functions and do not represent the actual transfer valves which might be used since any type of valve having identical operating characteristics can be substituted as needed. The same applies to the rotating starting valves in FIG. 2 as example, which can be substituted by poppet valves or any suitable valves having the same operating characteristics, including the interlocking device shown, without departing from the underlying principle.

Figure 1:
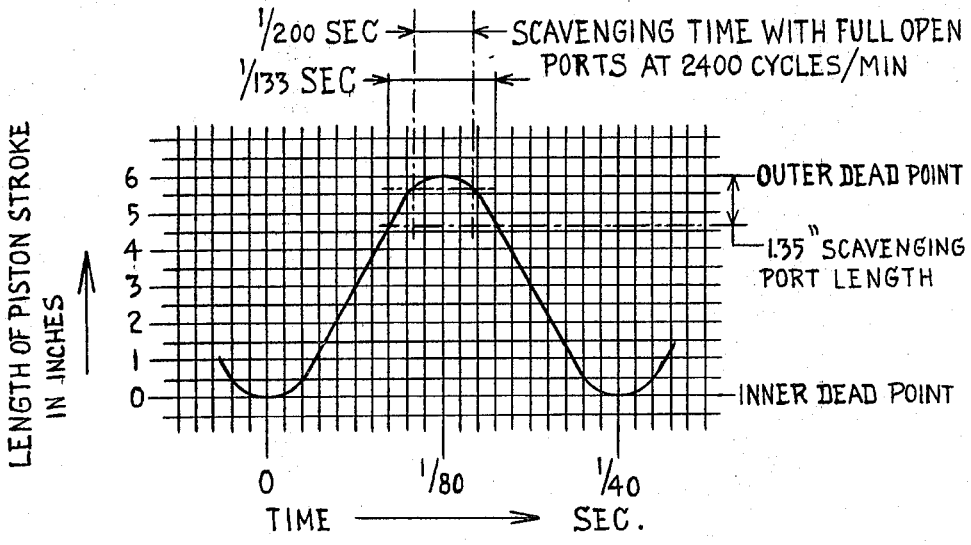
FIG. 1 is an explanatory diagram showing the piston stroke versus time curve with the related scavenging time of 1/200 second for fully open ports, of an existing single cylinder free piston gas generator engine, running at 2400 cycles/minute at an output of 350 gas H.P. with a maximum efficiency of 35%, providing therefore a comparison with engines according to the present invention.

According to the above descriptions and Figures the advantages of the present invention are, by way of some examples, as follows:

By choosing an efficient scavenging time of 1/100 second at full cyclic speed, which is twice as large as the 1/200 second shown in the diagram of FIG. 1, it is possible to design an efficient engine assembly according to the present invention, made with three identical engine cylinders, interconnected in series by the transfer loop as described and shown in FIG. 3, 4 and 5, with a cyclic frequency of 3000 cycles/minute or 50 cycles per second, because the simultaneous outward and inward piston strokes require 1/100 second travel time inside two engine cylinders "A" and "B" respectively, while the motor piston assembly sets 9 of the third engine cylinder "C" are at rest in the outward scavenging position. Thus the scavenging time of each engine cylinder in sequence is $1\times1/100=1/100$ second at 3000 cycles per minute.

Similarly by adding a fourth identical engine cylinder "D" as shown at the bottom of FIG. 3 and connecting it to engine cylinder "C" and "A" with pipe sections 18 and 19 and by maintaining the scavenging time of 1/100 second, the cyclic frequency can be increased to 6000 cycles per minute with a travel time of 1/200 second per piston stroke. Said scavenging time per motor piston assembly 9 is now $2\times1/200=1/100$ second, since two motor piston assembly sets 9 are in sequence in the scavenging position, while two of them reciprocate.

Further, by adding a fifth identical engine cylinder as described above, the cyclic frequency can be increased to 9000 cycles per minute with a travel time of 1/300 second per piston stroke and said scavenging time per motor piston assembly set 9 becomes $3\times1/300=1/100$ second as above, since three motor piston assembly sets 9 are now in sequence in the scavenging position, while two of them reciprocate inside their engine cylinders.

If a sixth identical engine cylinder is added as described above, the cyclic frequency can be increased to 1200 cycles per minute, which gives a travel time of 1/400 second per piston stroke for each motor piston assembly set 9 and because four engine cylinders are now in sequence in the scavenging phase, while two are reciprocating, said scavenging time is still $4\times1/400=1/100$ second, for every engine cylinder interconnected by the transfer loop.

The above described engine assemblies can also be designed for example, with six engine cylinders in series and a maximum cyclic frequency of 6000 cycles per minute or 100 cycles per second with a travel time of 1/200 second per stroke for each motor piston assembly set 9 and because four engine cylinders are again in the scavenging position in sequence, while two are reciprocating the scavenging time of each motor piston assembly set 9 in this case is $4\times1/200=1/50$ second respectively.

In the same way, any engine assembly, designed according to the above descriptions, can be made to operate with a suitable and efficient scavenging time up to—and including the maximum cyclic frequency, regardless of piston inertia. Therefore the present invention gives the designer of such engine assemblies the freedom of many choices and to adapt to a particular size requirement very efficiently by matching the minimum possible motor piston assembly inertia, cyclic frequency, number of engine cylinders interconnected by the transfer loop and gas H.P. output or gas flow, with a scavenging time that gives the best results.

The present invention applies only to engine assemblies with three or more identical interconnected engine cylinders, because with two engine cylinders or siamese units, the ducting of the feedback or bounce energy from one cylinder to the other and back in a transfer loop, has the same effect as the bounce chambers of a single cylinder engine of known design, by returning their reciprocating piston sets immediately into the inward strokes without the benefit of an extended scavenging time delay, while in the outer dead points or scavenging positions.

Since the basic description of the engine assembly shown in FIG. 3, is also appropriate for the engine assemblies shown in FIG. 4 and FIG. 5, by substituting the above stated exceptions as required, it is deemed practical not to repeat said descriptions in full for said FIG. 4 and FIG. 5.

Furthermore, while the present application has disclosed efficient embodiments of the present invention, the applicant does not wish to be limited thereto as there might be changes made in the arrangement, disposition and form of the parts without departing from the principle of this invention as comprehended within the scope of the appended claims.

What is claimed is:

1. In a free piston gas generator assembly having a plurality of separate free piston gas generators, each free piston gas generator having a motor cylinder and at least one pair of bounce energy cylinders, and having a pair of free pistons, with each of the pair of free pistons comprising a motor piston contained with the motor cylinder and at least one bounce energy piston contained within the at least one bounce energy cylinder, the motor piston and the at least one bounce energy piston on each of the pair of free pistons being connected together for simultaneous movement, the improvement comprising:

the plurality consisting of at least three free piston gas generators;

a pair of transfer loops each having a closed loop pipe interconnecting the at least one bounce energy cylinder of one of the pair of free pistons in each of the plurality of free gas generators;

a plurality of transfer valves, each in fluid communication with one of the pair of at least one bounce energy cylinders of a respective free piston gas generator and the respective closed loop pipe;

each transfer valve being a two-way valve having an always open port in fluid communication with the respective bounce energy cylinder, an upstream port and a downstream port, each in fluid communication with the respective closed loop pipe, and the transfer valve being normally biased to shut the upstream port and moveable to overcome the bias to thereby shut the downstream port;

whereby movement of the bounce energy piston in the respective bounce energy cylinder in fluid communication with a respective one of the transfer valves transfers a fluid pressure increase through the normally open downstream port and the closed loop pipe to overcome the bias of a next successive transfer valve downstream in the closed loop pipe and shut the downstream port of that next successive downstream transfer valve to thereby increase the fluid pressure in the respective at least one bounce energy cylinder in fluid communication with that next successive downstream transfer valve, thereby driving the bounce energy piston in the bounce energy cylinder, in fluid communication with that next successive downstream transfer valve, and the interconnected motor cylinder, towards a firing position for that next successive downstream free piston gas generator;

the interconnection of the plurality of free piston gas generators through the closed loop transfer pipe thereby effecting a continuous sequential operation of each of the plurality of free piston gas generators; and a pair of starting valves each positioned between the transfer valve and bounce energy cylinder of each of the free pistons on at least one of the free piston gas generators in the gas generator assembly;

the starting valve having two positions, a starting position directing fluid pressure from a source of pressurized fluid into the respective bounce energy cylinder and blocking fluid communication between the bounce energy cylinder and the respective transfer valve, and a running position opening the fluid communication between the bounce energy cylinder and the respective transfer valve and shutting the fluid communication between the source of pressurized fluid and the bounce energy cylinder; wherein the starting valves of each pair of starting valves on a respective one of gas generators being connected to operate in unison to change from the starting position to the running position and from the running position to the starting position and having a linkage means operatively connected to the bounce energy pistons for preventing the placing of the starting valves in the starting position when the free pistons are in generally an inward dead point at the opposite end of travel of the free pistons from a scavenging position.

2. The free piston gas generator assembly of claim 1 wherein each of the transfer valves further comprises:

a spring member and a valve member, with the spring member connected to the valve member and exerting a force to hold the valve member in the biased position shutting the upstream port, an wherein sufficient pressure on the valve member overcomes the spring force and shuts the downstream port.

3. The free piston gas generator assembly of claim 8 further comprising:

a source of pressurized scavenging gas;

a scavenging inlet opening in each of the respective motor cylinders interconnecting the scavenging gas source and the motor cylinder and a scavenging exhaust opening in each of the respective motor cylinders, the scavenging inlet and exhaust openings being simultaneously uncovered by the motor pistons of the pair of free pistons in each free piston gas generator when the free pistons are in the scavenging position;

each of the bounce energy cylinders having a first portion on one side of the bounce energy piston and a second portion on the other side of the bounce energy piston with the first and second portions varying in size depending upon the position of the bounce energy piston;

a pressure equalization means for equalizing the pressure in the first and second portions of the bounce energy cylinder when the respective free piston is in the scavenging position; and, pressurizing means, operating in conjunction with the respective transfer valve returning to its normal biased position, for pressurizing the closed loop pipe between the respective transfer valve and the respective transfer valve on the next sequential downstream free piston gas generator.

4. The free piston gas generator assembly of claim 3 wherein the pressure equalization means further comprises:

at least one first fluid inlet port in the bounce energy cylinder and at least one second fluid inlet port in the bounce energy cylinder, with the at least one first fluid inlet port being in the first portion of the bounce energy cylinder when the respective free piston is in the scavenging position and the at least one second fluid inlet port being in the second portion of the bounce energy cylinder when the respective free piston is in the scavenging position, and the fluid inlet ports being in fluid communication with a source of pressurized fluid.

5. The free piston gas generator assembly of claim 3 wherein the pressurizing means further comprises:

a fluid conduit in fluid communication with a source of pressurized fluid and in fluid communication with the always open portion of the respective transfer valve.

6. The free piston gas generator assembly of claims 4 or 5 wherein the source of pressurized fluid is the source of scavenging gas.

7. The free piston gas generator assembly as in any of claims 1-5 wherein the at least one bounce energy cylinder of each of the pair of free pistons of each of the at least three free piston gas generators further comprises:

a first and a second bounce energy cylinder each containing a bounce energy piston interconnected for simultaneous movement and both interconnected for simultaneous movement with the motor piston of the respective one of the pair of free pistons.

8. The free piston gas generator assembly as in any of claims 1-5 wherein:

the fluid contained in each of the bounce energy cylinders and in the closed loop pipe is hydraulic fluid.

9. In a free piston gas generator assembly having a plurality of separate free piston gas generators, each free piston gas generator having a motor cylinder and at least one pair of bounce energy cylinders and having a pair of free pistons, with each of the pair of free pistons having a motor piston contained within the motor cylinder and at least one bounce energy piston contained within the at least one bounce energy cylinder, the motor piston and the at least one bounce energy piston on each of the pair of free pistons being connected for simultaneous movement between an inner dead position and an outer dead position, with the inner dead position being the extent of travel of the respective one of the pair of free pistons prior to fuel combustion in the motor cylinder driving the pair of free pistons towards their respective outer dead positions, the improvement comprising:

the plurality consisting of at least three free piston gas generators;

transfer means for transferring the increased pressure in the at least one bounce energy cylinder of each pair of free pistons on a first firing gas generator to the corresponding one of the at least one bounce energy cylinder in a next sequentially firing gas generator to drive the respective one of the pair of free pistons in the next sequentially firing gas generator to the inward dead position, and for preventing the pressure increase in the at least one bounce energy cylinder of the first sequentially firing gas generator from driving the respective one of the pair of free pistons in the first sequentially firing gas generator to the inward dead position until the last sequentially firing of the gas generators in the gas generator assembly has combustion occur in the motor cylinder thereof, thereby increasing the pressure in the at least one bounce energy cylinders thereof, which increased pressure is transferred through the transfer means to the first sequentially firing gas generator to thereby begin the sequential firing of each of the gas generators again; and a pair of starting valves each positioned between the transfer means and bounce energy cylinder of each of the free pistons on at least one of the free piston gas generators in the gas generator assembly;

the starting valve having two positions, a starting position directing fluid pressure from a source of pressurized fluid into the respective bounce energy cylinder and blocking fluid communication between the bounce energy cylinder and the respective transfer means, and a running position opening the fluid communication between the bounce energy cylinder and the respective transfer means and shutting the fluid communication between the source of pressurized fluid and the bounce energy cylinder; wherein the starting valves of each pair of starting valves on a respective one of gas generators being connected to operate in unison to change from the starting position to the running position and from the running position to the starting position and having a linkage means operatively connected to the bounce energy pistons placing of the starting valves in the starting position when the free pistons are in generally an inward dead point at the opposite end of travel of the free pistons from a scavenging position.

* * * * *